US008397868B1

(12) United States Patent
Ferree

(10) Patent No.: US 8,397,868 B1
(45) Date of Patent: Mar. 19, 2013

(54) SIGNAL MAST WITH FOLDING STAND

(75) Inventor: James J. Ferree, Kansas City, KS (US)

(73) Assignee: J & A Industries, Inc., Kansas City, KS (US)

( * ) Notice: Subject to any disclaimer, the term of this patent is extended or adjusted under 35 U.S.C. 154(b) by 335 days.

(21) Appl. No.: 12/750,384

(22) Filed: Mar. 30, 2010

(51) Int. Cl.
*E06C 9/06* (2006.01)

(52) U.S. Cl. ..... 182/116; 182/18

(58) Field of Classification Search ..... 182/116, 182/114, 129, 151, 93, 86, 83, 18, 107; 52/40, 52/651.01, 651.02, 651.07, 854; 246/473.1, 246/473 R; 116/63 R
See application file for complete search history.

(56) References Cited

U.S. PATENT DOCUMENTS

| | | | | |
|---|---|---|---|---|
| 279,347 | A * | 6/1883 | Creecy et al. | 182/51 |
| 2,340,351 | A | 2/1944 | Thornburg | |
| 2,662,797 | A * | 12/1953 | Moon | 182/114 |
| 3,289,364 | A | 12/1966 | Watts, Jr. et al. | |
| 3,444,512 | A | 5/1969 | Reinitz | |
| 3,952,978 | A | 4/1976 | Reinitz | |
| 4,231,200 | A | 11/1980 | Henderson | |
| 4,440,262 | A * | 4/1984 | Hunt et al. | 182/114 |
| 5,008,967 | A | 4/1991 | Barrios et al. | |
| 5,216,867 | A | 6/1993 | Wasterval, Jr. et al. | |
| 5,639,047 | A | 6/1997 | Boget et al. | |
| 5,794,387 | A | 8/1998 | Crookham | |
| 6,189,839 | B1 | 2/2001 | Lemieux | |
| 6,270,043 | B1 | 8/2001 | Alfrey | |
| 6,301,841 | B1 | 10/2001 | Rhebergen et al. | |
| 7,062,883 | B1 | 6/2006 | Langholz et al. | |
| 7,561,066 | B2 | 7/2009 | Ashton | |
| 2006/0251454 | A1 | 11/2006 | Ashton et al. | |
| 2009/0218144 | A1 | 9/2009 | Donnally et al. | |

FOREIGN PATENT DOCUMENTS

| | | | |
|---|---|---|---|
| CA | 2246620 | A1 * | 3/2000 |

* cited by examiner

*Primary Examiner* — Katherine Mitchell
*Assistant Examiner* — Kristine Florio
(74) *Attorney, Agent, or Firm* — Erickson, Kernell, Derusseau & Kleypas, LLC

(57) ABSTRACT

A railway signal mast assembly including a signal mast and one or more signal light support arms for supporting a railway signal light on the mast includes a collapsible worker support cage attached to the signal mast proximate each set of signal light support arms to allow a worker to access the signal light mounted thereon for purposes of installation and maintenance. Each worker support cage includes a worker support platform and at least one side rail each pivotally attached to the signal mast and pivotal between stowed and use positions.

15 Claims, 6 Drawing Sheets

24
204
201
202
66
112
131
139
138
135
133
136
116
119
115
140
141
171
167
125
124
120
121
117
126
171
68
67
10
46
49
45
158
54
58
53
48
169
152
154
159
173
151
155
54
11
166
168
172
83
71
173
153
96
92
102
94
97
104
103
101
74
75
82
90
65
86
87
76
204
77
8
202
201
81
84
23
79
172
69
211
212
213
214
217

SIGNAL MAST WITH FOLDING STAND

BACKGROUND OF THE INVENTION

1. Field of the Invention

This invention relates to railway signal mast assemblies, and in particular to a railway signal mast with a support platform for supporting a worker in close proximity to a railway signal light assembly supported on the signal mast.

2. Background & Description of the Related Art

Many railroad tracks, crossings and junctions are provided with masts for displaying signal lights or colorlites to communicate rail conditions and speed or movement restrictions to the locomotive engineer. Signal lights are commonly mounted in the viewing line of the locomotive engineer to accommodate easy viewing of the signal lights from the train. Historically, signal lights have been mounted on trackside vertical masts or on structures built over the tracks including on signal bridges or cantilevered masts. Signal lights mounted on trackside vertical masts are typically mounted starting at around 12 to 15 feet or higher above the track for easy viewing by the locomotive engineer. Although many railroads historically mounted trackside vertical masts on the right hand side of the track, many railroads have switched to bi-directional tracks. In order to accommodate this change, signal masts are installed not only on either the left or right hand side of the tracks in which they govern, but are also commonly equipped to signal trains approaching from either direction on the track.

Maintenance, repair or replacement of signal lights requires convenient access to the signal lights in order to quickly service the lights and avoid disrupting rail traffic. Access for maintenance, repair or replacement of the signal lights mounted on vertical trackside signal masts is commonly provided by a ladder and platform or series of platforms proximate each signal light. The ladder and platforms allow for an operator to service the signal lights and mast on location and while the signal lights are installed on the mast.

Prior art signal mast assemblies, comprising the mast, ladder, platforms, and other associated mast parts, are transported as separate pieces to the installation site. The parts are commonly transported by container or flatbed truck. Transporting the signal mast assemblies creates inefficiencies because the parts required to complete one assembly are often mixed with parts of other assemblies. Additionally, safety hazards to people moving about the parts can occur during shipping because various stacked parts may shift and become unstable during transport.

Assembly of the prior art signal masts commonly requires multiple workers, assistance of a lifting means such as a boom truck and more than an hour to complete the assembly. The mast is laid directly on the ground to begin assembly and workers use a boom truck lifting means to position the platforms, ladders, and other parts into place to be bolted or attached to the mast. As parts are bolted onto the mast, the weight and forces from the workers and attached parts may cause the mast to shift or rotate. Shifting of the assembly makes the assembly process more difficult; it also creates pinch points between the mast assembly and the ground where a body part may become trapped, pinched, or crushed. After assembly of the signal mast is completed, a lifting means is used to lift the assembly into place onto a foundation. The base of the signal mast is commonly bolted or secured onto the foundation for final installation. Prior art signal mast installations also commonly include a foundation to secure the mast ladder.

Because of the multiple parts required to assemble a signal mast, storage and transport of the signal masts is cumbersome; assembly and installation of the signal mast is time consuming. Few advances have been made to signal masts to address the challenges and hazards involved with the prior art. As a result of the shortcomings of the prior art, railroad representatives have expressed interest in signal mast towers having collapsible cages or that are otherwise easier to assemble and install.

SUMMARY OF THE INVENTION

A railway signal mast assembly, including a signal mast and a signal support arm for supporting a railway signal light or other type of railway signal on the mast, is provided with one or more collapsible platform assemblies or worker support cages attached to the signal mast proximate the signal support arm to allow a worker to access the signal mounted thereon for purposes of installation and maintenance. Each worker support cage includes a worker support platform and at least one and preferably two support rails each pivotally attached to the signal mast. The platform and support rails are pivoted or folded into a stowed position prior to installation of the signal mast assembly to facilitate transport to the installation site. The platform and support rails may then be quickly unfolded and secured in a use position prior to installation of the signal mast assembly at the selected installation site.

The signal mast assembly includes a ladder for accessing the platforms in the use position. A lower ladder support is pivotal between a stowed position during transport and a use position in which it is used to support a lower end of the ladder and thereby eliminating the need for a foundation to secure the ladder in place. The ladder is then further secured to ladder supports connected to each worker support cage.

The ladder is preferably formed in two identical sections which are secured together prior to installation. The ladder sections, and additional hardware used to form the signal mast assembly may be supported on the collapsed worker support cages and secured in place by strapping or the like during transport of the signal mast assembly. Stacking bracket assemblies are attached to the mast at or near each end for stacking multiple railway signal mast assemblies on top of each other when the worker support cages are folded to a stowed position and with the ladder sections and any other hardware secured thereto.

DETAILED DESCRIPTION OF THE PREFERRED EMBODIMENTS

Figure 1:
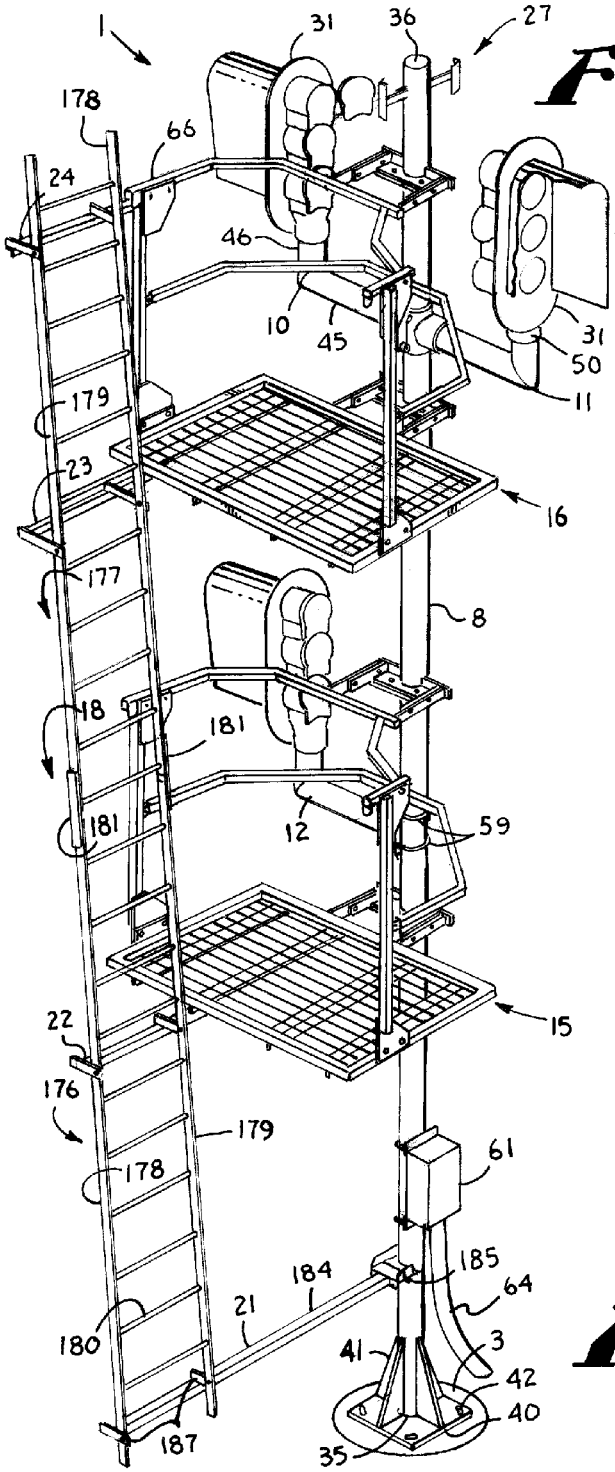
FIG. 1 is a perspective view of an assembled signal mast assembly installed on a footing with signal lights installed on the signal mast assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

It is to be understood that while certain forms of the present invention have been illustrated and described herein, it is not to be limited to the specific forms or arrangement of parts described and shown.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" is used with reference to an element is the language intended to be limited to one of the elements specified, or any other similarly limited number of elements.

Figure 2:
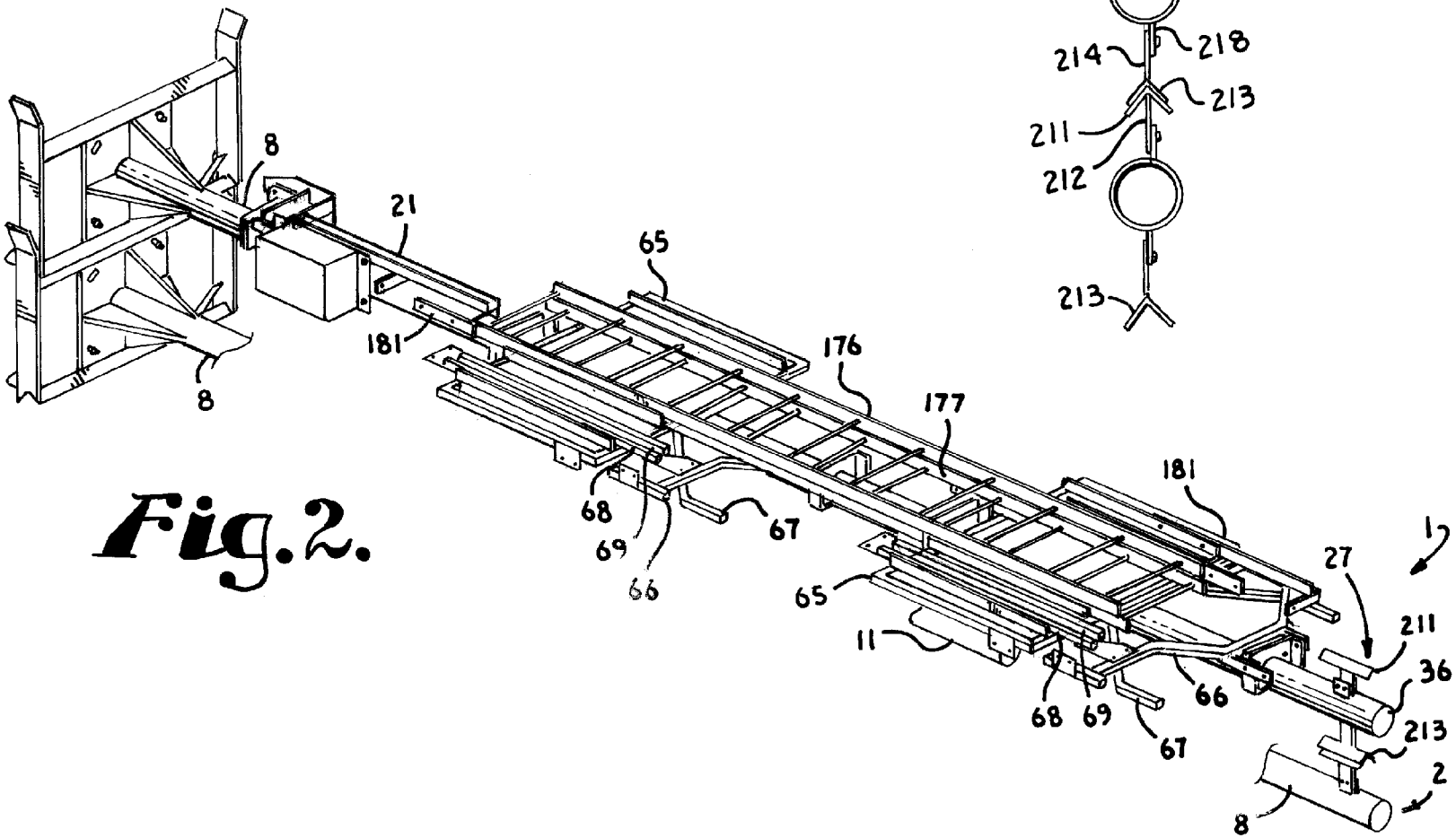
FIG. 2 is a perspective view of the signal mast assembly folded, stowed and stacked on another signal mast of the same embodiment using upper and lower stacking bracket assemblies and without signal lights attached.

Referring now to the drawings in more detail, there is shown an embodiment of a railway signal mast assembly of the present invention indicated generally by the reference numeral 1. FIG. 1 shows the signal mast assembly 1 assembled and installed in what may be referred to as a use position or configuration. FIG. 2 shows the signal mast assembly 1 in a stowed or transport configuration prior to assembly and supported on top of a second, identical signal mast assembly 2 to facilitate efficient storage and transportation of the signal mast assemblies. In a preferred embodiment up to four signal mast assemblies may be stacked, one on top of another. Portions of the second or lower signal mast assembly 2 have been removed for clarity while showing the stacking structure as discussed in more detail hereafter.

After transporting the signal mast assemblies to a selected site, the upper signal mast assembly 1 is removed from the stack of up to four signal mast assemblies using a fork lift or other suitable lifting means and positioned on the ground near a footing formed therein. The signal mast assembly 1 is then assembled as described in more detail hereafter and lifted and positioned over the footing 3 and secured in place on threaded studs (not shown) projecting upwards from the footing 3.

The railway signal mast assembly 1 generally comprises a tubular mast or column 8 supporting signal mounting arms 10, 11 and 12, collapsible or foldable worker support cages 15 and 16, ladder assembly 18, ladder supports 21, 22, 23 and 24 and upper and lower stacking bracket assemblies 27 and 28. A railway signal light assembly 31 is mounted on each signal mounting arm 10-12 respectively. The signal light assemblies 31 are shown mounted on the mast 8 at two different heights or levels and the worker support cages 15 and 16 are mounted on the mast 8 at corresponding levels or heights to facilitate worker access to the signal light assemblies 31. It is to be understood that additional cages could be utilized on a taller mast assembly with additional signal arms. The worker support cages 15 and 16 may more commonly be referred to as platforms or platform assemblies. However, the term cage is used herein to more clearly distinguish the assembly over the platform itself that forms part of the assembly which further includes top and mid-rails as discussed in more detail hereafter.

Figure 3:
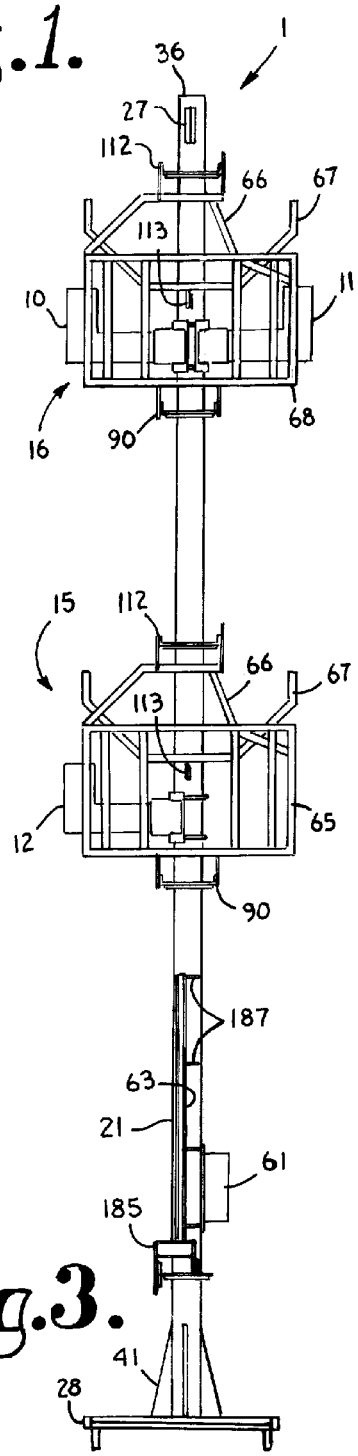
FIG. 3 is a top plan view of on of the folded and stowed signal mast assembly with a ladder assembly and other loose components removed.
Figure 5:
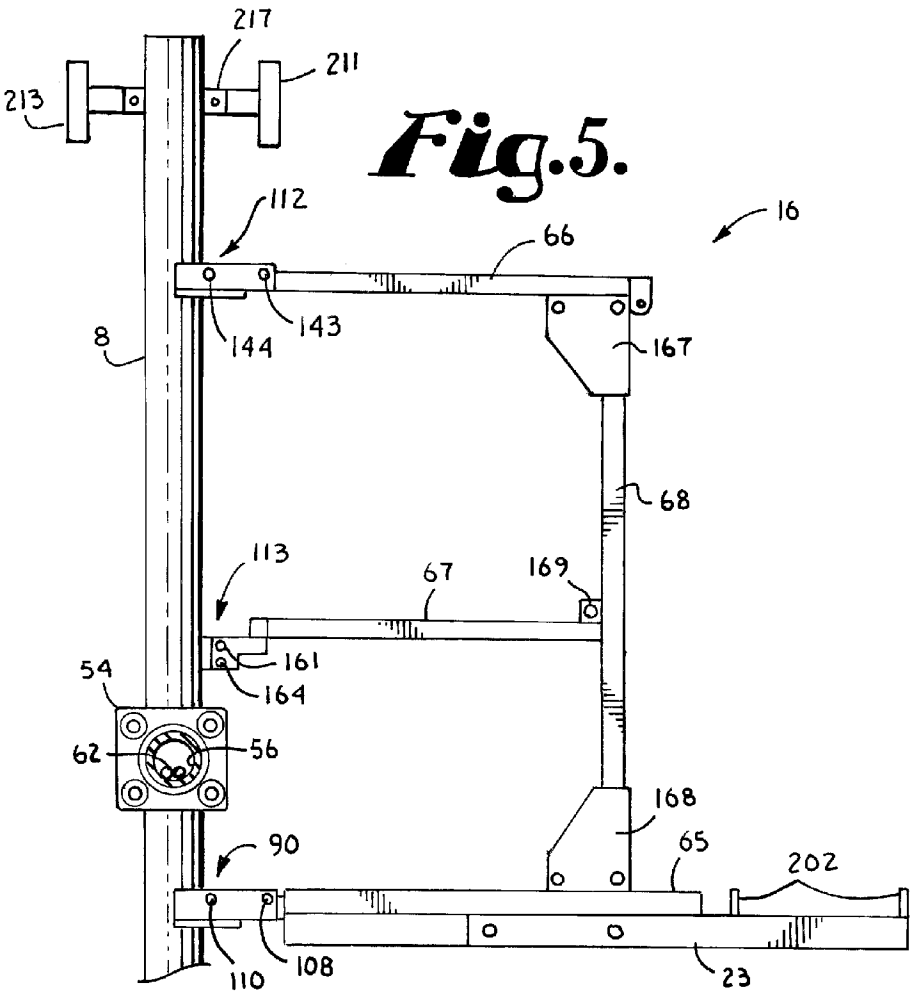
FIG. 5 is a fragmentary side view of the signal mast assembly as shown in FIG. 1 showing the upper platform assembly unfolded and assembled.
Figure 4:
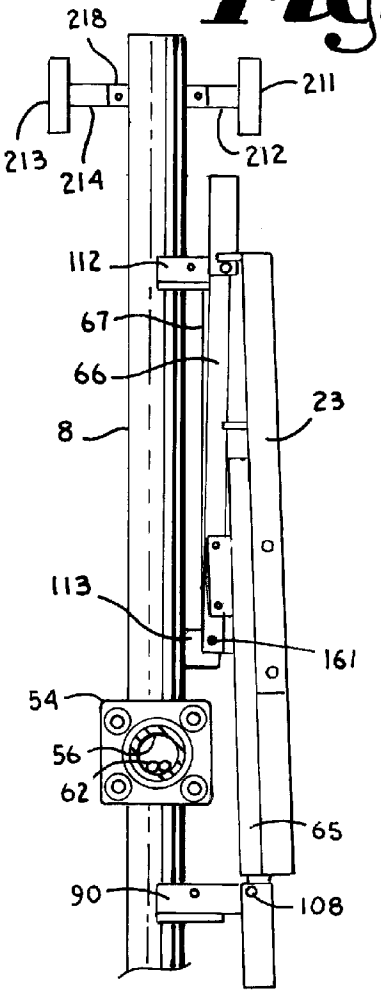
FIG. 4 is a fragmentary side view of the folded and disassembled upper platform assembly as shown in FIG. 3.
Figure 6:
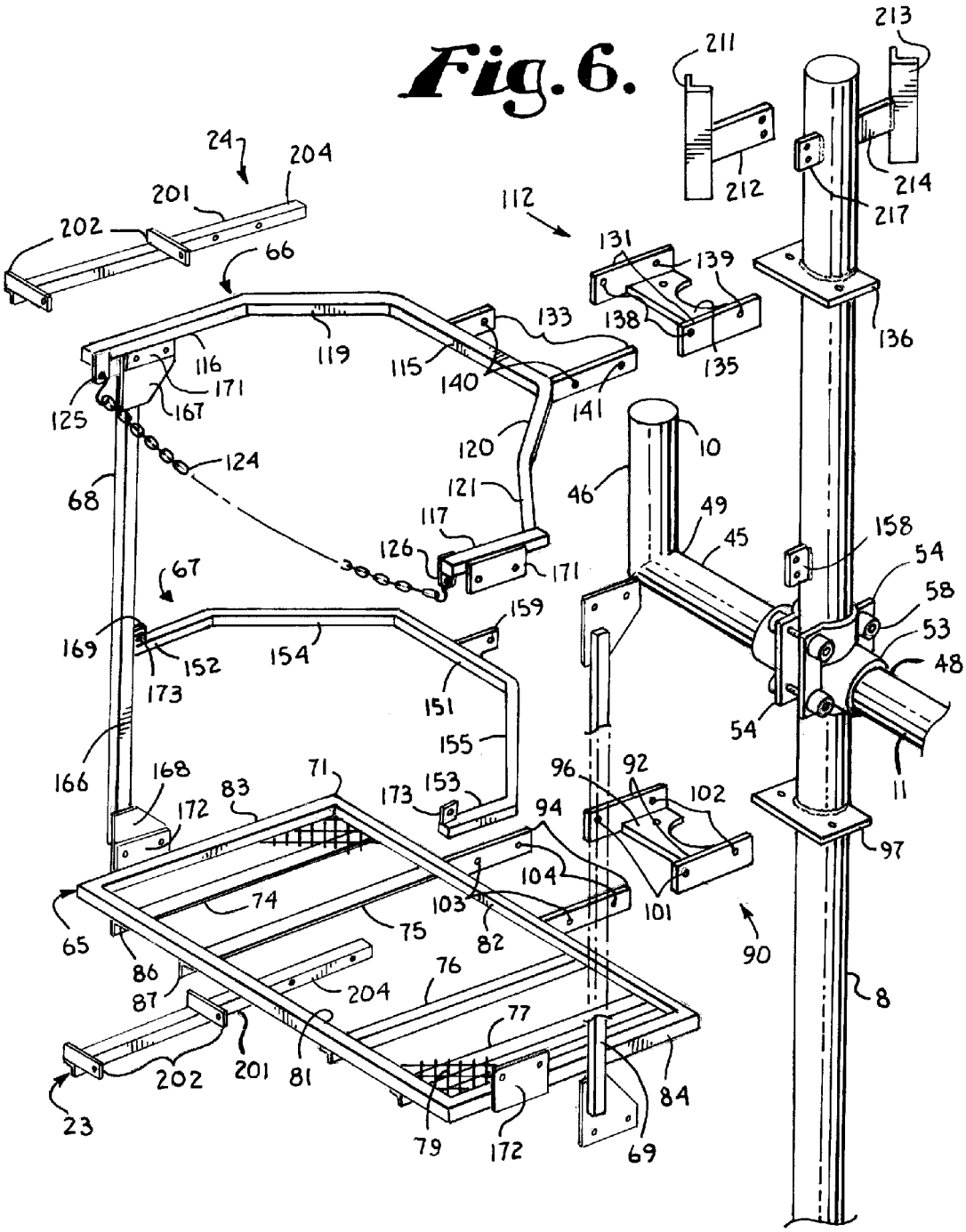
FIG. 6 is a fragmentary and exploded perspective view of the mast assembly showing the upper platform assembly and upper stacking bracket in detail.
Figures 7, 11:
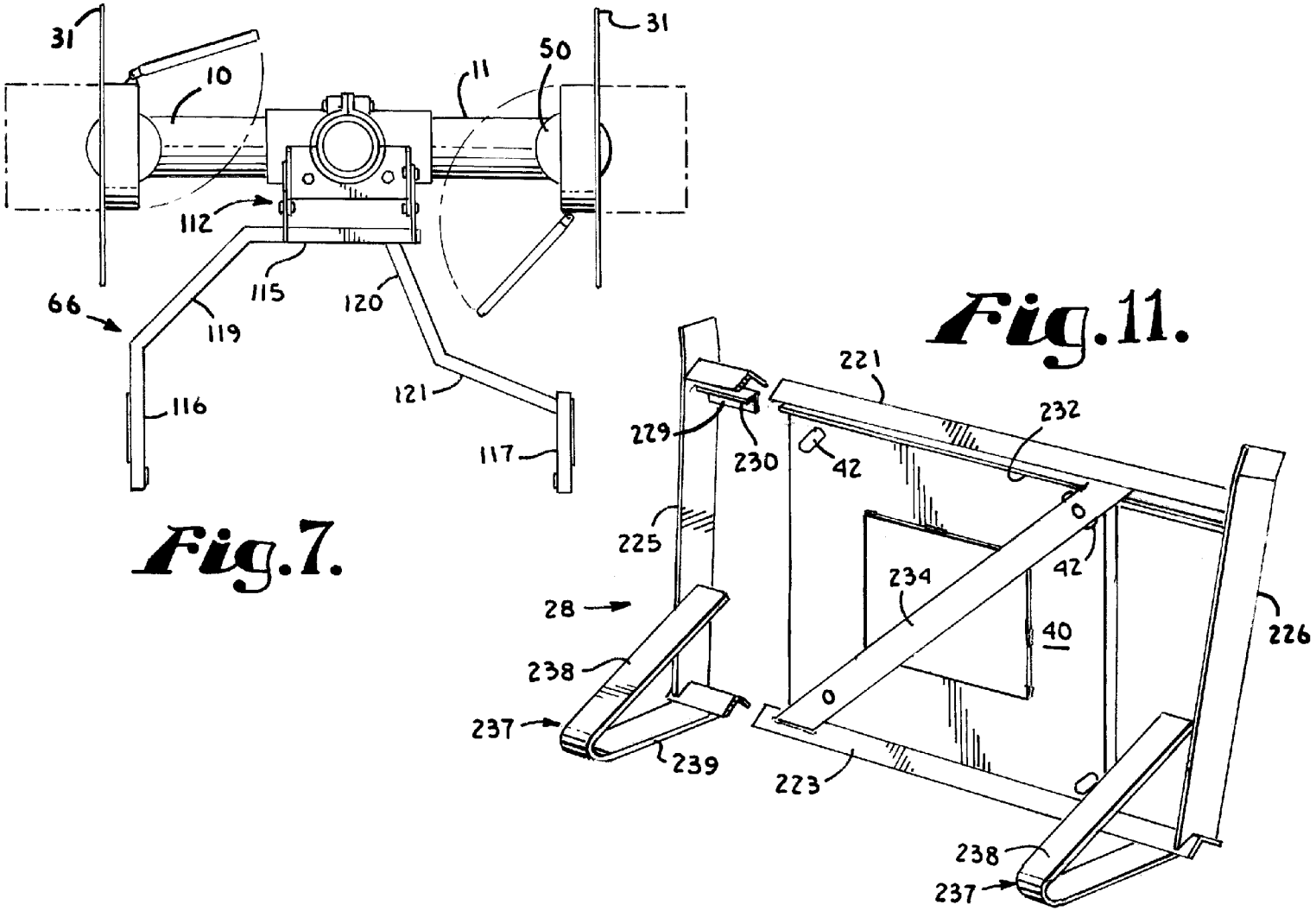
FIG. 7 is a fragmentary top view of an unfolded top rail of the upper platform assembly with signal lights installed on the assembly
FIG. 11 is a perspective view of a lower end of the signal mast assembly showing a lower stacking bracket attached to a base plate of the mast assembly.
Figure 9:
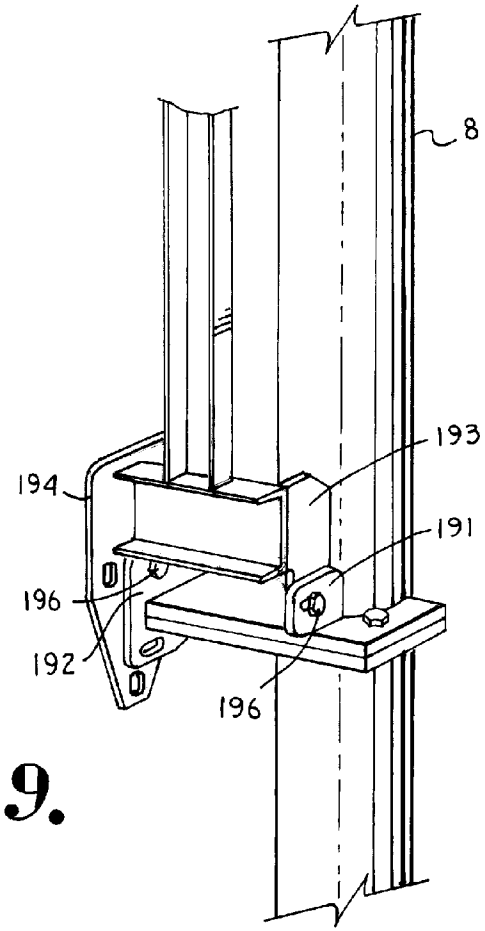
FIG. 9 is a view similar to FIG. 8 showing the lower ladder support in a raised, stowed position.
Figure 8:
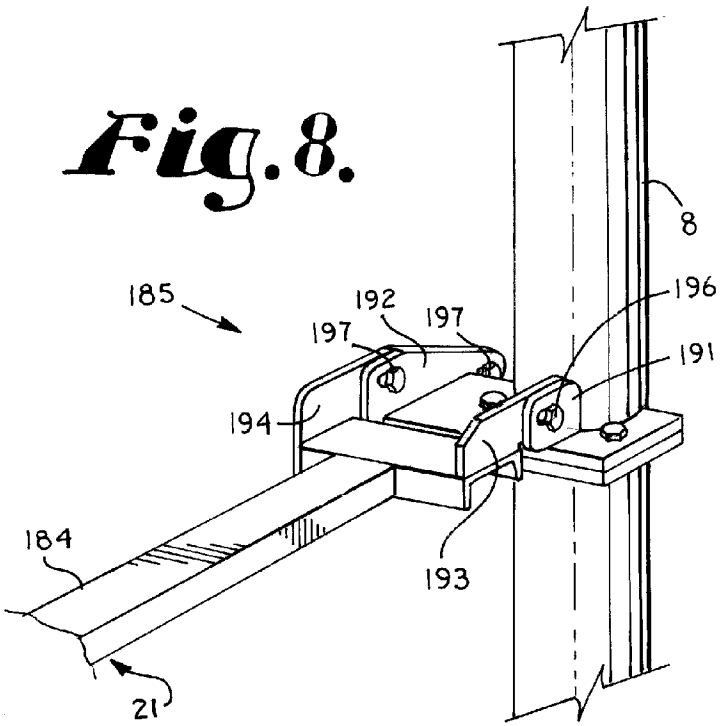
FIG. 8 is a fragmentary, perspective view of the signal mast assembly showing a lower ladder support connected to a mast of the mast assembly by a hinge and with the ladder support in a lowered, use position.

FIGS. 3 and 4 show the signal mast assembly 1 with the worker support cages 15 and 16 in the stowed position and with the ladder assembly 18 removed. FIGS. 5 through 7 show the upper worker support cage 16 in a use position and FIGS. 8 and 9 show details of the lower stacking bracket assembly 28.

The railway signal mast assembly 1 of the present embodiment is constructed from industrial grade, high gauge metal or iron where required for load bearing or high strength as known to one of ordinary skill in the art. Alternatively, the mast assembly 1 may be constructed of other materials to suit the required strength of the application. As illustrated in the figures, often times generally available angle iron, channel iron, tubular metal or pipe may be used.

With reference to the signal mast assembly 1 as oriented in the use position as shown in FIG. 1, the tubular mast 8 may be described as having a lower end 35 and an upper end 36 with a substantially cylindrical cavity extending along a longitudinal axis thereof. A base plate 40 is welded to the lower end 35 of the mast 8. Four diametrically opposing gussets 41 are attached to the base plate 40 and the mast 8 to reinforce the connection of the base plate 40 to the lower end 35 of the mast 8. The base plate 40 includes four bolt receiving holes or slots 42 for receiving the anchor bolts or threaded studs (not visible) projecting upwards from the footing 3.

The signal light mounting arms 10-12 are tubular and as discussed above are attached to the mast 8 at varying heights and in varying directions. Each mounting arm 10-12 includes a horizontal segment 45 and a vertical segment 46 (see also FIG. 6). The horizontal segment 45 is connected at a first or inner end 48 to the mast 8. The vertical segment 46 projects upward from a second or outer end 49 of the horizontal segment 45 and parallel to the mast 8. A mounting hub 50 of a signal light assembly 31 is supported on an upper distal end 51 of the vertical segment 46 of each signal light mounting arm 10-12. It is foreseen that the signal light mounting arms 10-12 may be installed in varying directions or adapted for mounting other items including, but not limited to, speakers, flags, spotlights or other such items.

The inner end 48 of each mounting arm horizontal segment 45 is received in and welded to a mounting hub 53 of a clamp member 54. An inner surface of the clamp member 54 matches the contour of the mast 8 such that the clamp member 54 rests flush against the mast 8. The clamp member 54 is positioned over and aligned with an opening or bore 56 in the mast 8 (see FIGS. 4 and 5) such that electrical wiring and conduit may be routed from the mast cavity and through the mounting arms 10-12 and to the signal light assemblies 31 supported thereon. Opposed clamp members 54 supporting opposingly directed signal mounting arms 10 and 11 on opposite sides of the mast 8 are bolted together using straight bolts 58 and tightened sufficiently to clamp the clamp members 54 around the mast 8. When a single signal mounting arm 12 is used at a selected level, U-bolts 59 (see FIG. 1) may be used to clamp the clamping member 54 around the mast 8. Alternatively, other embodiments of the present invention may use other methods of attaching the signal light mounting arm 10-12 to the mast 8 including welding or the like.

A junction box 61 is attached to the mast 8 for connecting wiring for the electric signal light assemblies or colorlites 31. Electrical wiring 62 is pre-installed from the junction box 61 to each signal mounting arm 10-12. The wiring 62 in the signal mast assembly 1 is connected to on-site wiring (not shown) that is fed or routed through an opening in the bottom of the junction box 61. The on-site wiring will typically project out of the ground near the footing 3. A flexible conduit 64 may be provided with the signal mast assembly 1 for covering and protecting the on-site wiring. An annular connector (not shown) may be secured to one end of the conduit 64 for connecting the conduit to the junction box 61. The pre-installed wiring 62 runs from the junction box 42, up through the mast cavity, through the openings 56 in the mast 8, through the signal mounting arms 10-12 and to each of the signal light assemblies 31 mounted thereon. Methods of installing electrical wiring at the junction box 61 and the signal lights are generally known to one of ordinary skill in the art.

As best seen in FIGS. 1 and 3-6 each worker support cage 15 and 16 generally comprises a platform 65, top rail 66 and mid rail 67 and first and second vertical supports 68 and 69. The platform 65, top rail 66 and mid rail 67 are each pivotally connected to the mast 8 and pivotal between a stowed position as shown in FIGS. 2 through 4 and a use position as shown in FIGS. 1, 5 and 6. The vertical supports 68 and 69 are connected to and extend vertically between the platform 65, mid rail 67 and top rail 66 when advanced to the use position to provide vertical support therebetween.

Each platform 65 comprise a rectangular frame 71, platform support members 74, 75, 76 and 77 and a rigid grate 79 or other load bearing flooring suitable to accommodate a person standing thereon. Grating is a preferred material for the flooring as it allows precipitation to drain therethrough. The platform frame 71 comprises a front frame member 81, a rear frame member 82 and two side frame members 83 and 84. The side frame members 83 and 84 are welded substantially perpendicular to the front and back frame members 81 and 82 to form a substantially rectangular frame 71.

The platform support member 74-77 as shown are formed from angle iron and include a top leg 86 and a perpendicularly extending side leg 87. The top leg 86 of each platform support member 74-77 is welded to the bottom surfaces of the front and back frame members 81 and 82 substantially parallel to the side frame members 83 and 84. The two inner platform support members 75 and 76 are outwardly offset from a center position of the platform frame 71; this center position is generally in line with the longitudinal axis of the mast 8. The grate 79, is supported on and welded to the top leg 86 of each support members 74-77 within the platform frame 71.

As best seen in FIGS. 4-6, the platform 65 is pivotally connected to the mast 8 by platform hinge assembly or platform hinge 90. The platform hinge assembly 90 includes a first pair of hinge members or arms 92 fixedly mounted to and projecting forward from the mast 8 and a second pair of hinge members or arms 94 fixedly mounted to and projecting rearwardly form the rear frame member 82 of the platform frame 71. The first pair of hinge members 92 are welded to and interconnected by a web or plate 96 which is bolted to a hinge mounting flange 97 welded to the mast 8. The inner profile of the interconnecting web 96 and of hinge mounting flange 97 matches the profile of the mast 8 such that the interconnecting web 96 is flush with the mast 8 when bolted to the hinge mounting flange 97. The first pair of hinge arms 92 may be referred to as the mast hinge arms 92 and the second pair of hinge arms 94 may be referred to as the platform hinge arms 94.

Stops 99 are welded to and project outward from the sides and top of each of the mast hinge arms 92. Rear portions of the stops 99 are also welded to the interconnecting plate 96 to provide additional strength.

The mast hinge arms 92 include first and second sets of aligned holes 101 and 102 formed therein with the first set of holes 101 spaced in front of the second set 102. Similarly, the platform hinge arms 94 include first and second sets of aligned holes 103 and 104 formed therein with the first set 103 spaced in front of the second set 104. The spacing between the first and second set of aligned holes 101 and 102 in the first pair of hinge arms 92 is the same as the spacing between the first and second set of aligned holes 103 and 104 in the second pair of hinge arms 94.

The second pair of hinge arms 94 are pivotally connected to the first pair of hinge arms 92 by pivot bolts or connectors 108 extending through holes 101 in the first pair of hinge arms 92 aligned with holes 103 in the second pair of hinge arms 94 and secured in place with nuts (not sown). The pivot bolts 108 preferably are the type wherein a portion of the shank adjacent the head is not threaded and provides a relatively smooth surface relative to which the hinge arms 92 and 94 may pivot. The smooth shank also prevents over-tightening of the nut and bolt 108 against the hinge arms 92 and 94. When the platform 65 is pivoted to the use position, distal ends of the platform hinge arms 94 engage the stops 99 on the mast hinge arms 92 to hold the platform 65 in the use position and prevent the platform 65 from rotating past the use position. As shown in FIGS. 1, 5 and 6, safety bolts 110 inserted through holes 104 in hinge arms 94 aligned with holes 102 in hinge arms 92, prevent the platform 65 from inadvertently pivoting relative to the mast 8 so as to hold or maintain the platform 65 in the use position while the rest of the cage 15 or 16 is constructed. Safety bolts 110 are secured in place with nuts (not shown). As used herein and unless specified otherwise any reference to a bolt for bolting two elements together is intended to indicate that a nut or some other complementary fastening means (whether or not shown) is used to secure the bolt in place. The safety bolts 110 may also be referred to as locking bolts or connectors 110.

When the platform 65 is in the stowed position, as shown in FIGS. 1, 3 and 4, the platform 65 extends generally parallel to the longitudinal axis through the mast 8. When the platform 65 is pivoted to and locked in the use position, it extends generally perpendicular to the longitudinal axis of the mast 8.

The platform 65 is generally pivoted upwards from the stowed position to the use position about a pivot axis extending through the pivot bolts 108.

The top rail 66 and mid rail 67 are also pivotally connected to the mast 8 by hinge assemblies 112 and 113 respectively of similar or related construction as platform hinge assembly 90. The top rail 66 is formed from tubular metal with a rear segment 115, and left and right side segments 116 and 117. The left and right side segments 116 and 117 of the top rail 66 are planarly aligned with the left and right side frame members 83 and 84 respectively of the platform frame 71. As best seen in FIG. 7, the left side segment 116 is connected to the rear segment 115 by an intermediate segment 119 extending generally at a forty-five degree angle therebetween. The right side segment 117 is connected to the rear segment 115 by a pair of intermediate segments; first segment 120 and second segment 121 which generally form an indentation in the top rail 66. The first segment 120 extends rearward from the rear segment 115 at an angle of approximately seventy degrees and the second segment 121 extends outward from the first segment 120 at an angle of approximately one hundred and thirty degrees such that it projects inward from the right side segment 117 at an angle of approximately seventy degrees. The indentation formed by segments 120 and 121 of top rail 66 accommodate the pivotal opening of a cover 122 on signal light assembly 31.

As best seen in FIG. 6, a front of the top rail 66, between the side segments 116 and 117 is open to allow ingress and egress to the platform 65. A safety chain or strap 124 is removably securable between left and right side eyelets 125 and 126 welded to distal ends of the left and right side segments 116 and 117 respectively of the top rail 66. The safety chain 124 is connected between the left and right side segments 116 and 117 of the top rail 66 once the worker is standing on the platform 65 to restrain the worker from falling out the front thereof. The eyelets 125 and 126 are preferably sized to allow a worker to connect a safety line between a selected eyelet 125 or 126 and a safety harness worn by the worker.

The top rail hinge assembly or top rail hinge 112 includes a first pair of hinge members or arms 131 fixedly mounted to and projecting forward from the mast 8 and a second pair of hinge members or arms 133 fixedly mounted to and projecting rearwardly form the rear frame segment 115 of the top rail 66. The first pair of hinge arms 131 are welded to and interconnected by a web or plate 135 which is bolted to a hinge mounting flange 136 welded to the mast 8. The inner profile of the interconnecting web 135 and of hinge mounting flange 136 matches the profile of the mast 8 such that the interconnecting web 135 is flush with the mast 8 when bolted to the hinge mounting flange 136. The first pair of hinge arms 131 may be referred to as the mast hinge arms 131 and the second pair of hinge arms 133 may be referred to as the top rail hinge arms 133. In the embodiment shown, the left, top rail hinge arm 133 is shorter than the right, top rail hinge arm 133.

The mast hinge arms 131 include first and second sets of aligned holes 138 and 139 formed therein with the first set of holes 138 spaced in front of the second set 139. The second pair of hinge arms 133 includes a set of aligned holes 140 formed therein with a second hole 141 formed in the right, top rail hinge arm 133 behind the first hole 140 therein. The spacing between the first and second set of aligned holes 138 and 139 in the mast hinge arms 131 is the same as the spacing between the first and second holes 140 and 141 in the right, top rail hinge arm 133.

The top rail hinge arms133 are pivotally connected to the mast hinge arms 131 by pivot bolts 143 extending through holes 138 in the mast hinge arms 131 aligned with holes 140 in the top rail hinge arms 133. When the top rail 66 is pivoted to the use position, as shown in FIGS. 1, 5 and 6, a safety bolt or locking bolt 144 inserted through hole 141 in right, top rail hinge arms 133 aligned with hole 141 in right, mast hinge arms 131, prevents the top rail 66 from inadvertently pivoting relative to the mast 8 during assembly of the cage 15 or 16.

When the top rail 66 is in the stowed position, as shown in FIGS. 1, 3 and 4, the top rail 66 extends generally parallel to the longitudinal axis through the mast 8. When the top rail 66 is pivoted to and locked in the use position, it extends generally perpendicular to the longitudinal axis of the mast 8. The top rail 66 is generally pivoted upwards from the stowed position to the use position about a pivot axis extending through the pivot bolts 143.

The mid rail 167 is formed from tubular metal and is semi-octagonal in shape with a rear segment 151, left and right side segments 152 and 153 and left and right side interconnecting segments 154 and 155. The left side interconnecting segment 154 extends between the rear segment 151 and left side segment 152 at a forty-five degree angle and the right side interconnecting segment 155 extends between the rear segment 151 and the right side segment 153 at a forty-five degree angle. The mid rail 67 is open across the front to allow ingress and egress to the platform 65 from the ladder assembly 18.

The mid rail 67 is pivotally connected to the mast column 8 and pivotal between a stowed position and a use position. In the stowed position, the mid rail 67 extends in a plane extending parallel to the axis of the mast 8. In the use position, the mid rail 67 extends perpendicular to the mast 8. The mid-rail 67 pivots downwards from the stowed position to the use position.

The mid rail 67 is pivotally connected to the mast by the mid-rail hinge assembly or mid-rail hinge 113. The mid-rail hinge 113 comprises a mid-rail hinge mounting member or tab 158 welded to the mast column 8 and a mid-rail hinge arm 159 welded to and projecting rearward from the rear segment 151 of the mid-rail 67. A pivot bolt 161 (see FIG. 5) pivotally connects to the mid-rail hinge arm 159 to the mid-rail hinge mounting tab 160 through upper aligned holes therein. When the mid-rail 67 is pivoted downwards to the use position, a lower set of holes in the hinge arm 159 and the hinge mounting tab 160 are aligned so that a locking or safety bolt 164 may be inserted therethrough to hold the mid-rail 67 in the use position.

Once the platform 65, top rail 66 and mid-rail 67 are secured in the use positions, the vertical supports 68 and 69 are connect the left and right sides respectively of the platform 65, top-rail 66 and mid-rail 67 to provide vertical stability to the left and right sides thereof. Each vertical support 68 and 69 comprises a middle, tubular portion or stem 166 with a flattened, mounting flange 167 and 168 welded to opposite ends thereof and an intermediate mounting tab 169 welded to and projecting to one side of the stem 166 near its middle.

Upper mounting brackets 171 for the vertical supports 68 and 69 are welded to the left and right side segments 116 and 117 of the top rail 66 and lower mounting brackets 172 are welded to the left and right side frame members 83 and 84 of the platform frame 71. Mounting tabs 173 are welded to the left and right side segments 152 and 153 of the mid-rail 67 near the distal ends thereof. The upper mounting flanges 167 of the vertical support members 68 and 69 are bolted to the upper mounting brackets 171 on top rail 66, lower mounting flanges 168 are bolted to the lower mounting brackets 172, and mounting tabs 169 on vertical support members 68 and 69 are bolted to the mounting tabs 173 on the mid-rail 67. Once the vertical supports 68 and 69 are bolted in place, the safety bolts 110 for platform 65, safety bolt 144 for top rail 66 and safety bolt 164 for mid rail 67 could be removed but for convenience sake likely will be left in place by the assembler.

The ladder assembly 18 as shown in FIGS. 1 and 2 is formed from first and second ladder sections 176 and 177 which are identical and interchangeable. Each ladder section includes a pair of side rails 178 and 179 and a plurality of rungs 180 extending therebetween. A splice bar 181 is welded onto an upper end of a first side rail 178 on an outer surface thereof. With reference to FIG. 1, the first ladder section 176 is oriented with the first side rail 178 on the left and the splice bar 181 at the upper end thereof overlapping. The second ladder section 177 is oriented with the first side rail 178 on the right and the splice barl 81 at the lower end thereof. Splice bar 181 on side rail 178 of first or lower ladder section 176 overlaps and is bolted to side rail 179 on the second or upper ladder section 177. Splice bar 181 on side rail 178 of the second or upper ladder section 177 overlaps and is bolted to side rail 179 on the first or lower ladder section 176.

The first or lower ladder support 21 is pivotally mounted to the mast 8 and pivotal between a stowed and a use position. The second and third ladder supports, or intermediate ladder supports, 22 and 23 are mounted on the platforms 65 of the first and second worker support cages 15 and 16 respectively. The fourth or upper ladder support 24 is mounted on the top rail 66 of the upper worker support cage 15.

The lower ladder support 21, includes a pivot arm or support arm 184 pivotally connected at a first end to the mast 8 by a hinge or pivot assembly 185 for pivoting the lower ladder support 21 between the stored and use positions. In the stowed position, the pivot arm 184 extends generally parallel to the axis of the mast 8. In the use position, the pivot arm 184 extends perpendicular to the mast axis. A pair of ladder mounting brackets 187 with bolt holes formed therein are welded to and project outward from the pivot arm 184 in spaced apart relation. The ladder mounting brackets 187 are spaced apart a distance to receive the first and second side rails 178 and 179 therebetween for bolting the side rails 178 and 179 to the ladder mounting brackets 187 through aligned holes therein.

The lower ladder support hinge 185 includes a first pair of hinge mounts 191 and 192 fixedly mounted to the mast 8 and a pair of hinge members or arms 193 and 194 fixedly mounted to and projecting rearwardly form the ladder support arm 184. The first hinge mount 191 and the first hinge arm 193 each include a single hole therethrough and are pivotally connected together by a pivot bolt. The second hinge mount 192 is larger than the first hinge mount 191 and extends across an opposite side of the mast 8 therefrom. The second hinge mount 192 includes three bolt holes therein. The second hinge arm 194 on the ladder support arm 184 is also enlarged relative to the first hinge arm 193 and includes three bolt holes therein. Pivot bolts 196 pivotally connect the first and second hinge arms 193 and 194 to the first and second hinge mounts 191 and 192 respectively to allow pivoting of the ladder support arm 184 from a raised and stowed position, parallel to the mast 8, to a lowered and use position, perpendicular to the mast 8. When the ladder support arm 184 is in the use position, the remaining two bolt holes in the second hinge arm 194 align with the remaining two bolt holes in the second hinge mount 192 so that locking bolts 197 may be bolted therethrough to lock the ladder support arm 184 in the use position.

The second, third and fourth ladder supports 22, 23 and 24 respectively are preferably similarly constructed and interchangeable. Each ladder support 22-24 includes a support arm 201 with a pair of ladder mounting brackets 202 welded to and projecting outward therefrom in spaced apart relation on an outer end of the support arm 201. The ladder mounting brackets 202 have bolt holes formed therein and are spaced apart a distance to receive the ladder side rails 178 and 179 therebetween. The ladder side rails 178 and 179 are then bolted to the mounting brackets 202. The support arm may be constructed of angle iron with two bolt holes (not shown) formed in the vertical leg of the angle iron near the end opposite the ladder mounting brackets 202, which may be referred to as a mounting end 204 of the support arm 201.

The pivotal ladder support 21, in the use position, extends outward from the mast 8, generally in planar alignment with the longitudinal axis of the mast 8. As best seen in FIG. 1, when the cages 15 and 16 are assembled in the use position, the ladder supports 22-23 are mounted on the platforms 65 of the cages 15 and 16 and the top rail 66 of the upper cage 16 respectively in incrementally further outward space relation relative to the mast 8 so that the ladder 18 angles outward from the bottom to the top relative to the mast 8. In the embodiment shown, the angle of incline of the ladder 18 outward from the mast 8 is approximately five percent (5%).

More specifically, ladder support 22 is attached to the left, inner platform support 75 of platform 65 of lower cage 15, while ladder support 23 is attached to the left, outer platform support 74 of platform 65 of upper cage 15. The ladder support 24 is then attached to the left side segment 116 of the top rail 66. The ladder supports 22 and 23 are attached to platform supports 75 and 76 by bolting the mounting ends 204 thereof to the platform supports 75 and 76 such that the ladder mounting brackets 202 of each ladder support 22 and 23 extend forward of the respective platform 65. The mounting end 204 of ladder support 24 is bolted to the mounting bracket 171 welded to the left side segment 116 of top rail 66 of upper cage 16 with the mounting brackets 202 extending forward of the left side segment 116. Both the upper mounting flange 167 of vertical support 68 and the mounting end 204 of ladder support 204 are bolted to the mounting bracket 171 on top rail left side segment 116.

For signal mast assemblies having a single signal mounting arm or a single set of signal mounting arms, such as arms 10 and 11 mounted toward the upper end of the mast 8 only a single worker support cage 16 is connected to the mast 8. To provide additional support for the ladder 18, a second pivotal ladder support assembly similar to lower ladder support 21 is mounted to the mast 8 below the worker support cage 16 generally where the lower worker support platform 65 would be positioned. This additional pivotal ladder support is modified slightly over lower ladder support 21 to offset the arm for this additional ladder support relative to the mast 8 to position it where the support arm for intermediate ladder support 22 would have otherwise been positioned to accommodate the angle of the ladder 18.

Referring now to FIG. 2, the upper and lower stacking bracket assemblies 27 and 28 are used to facilitate stacking signal mast assemblies 1 and 2 in a collapsed or stowed configuration on top of each other. In the stowed or stowed configuration, the lower ladder support arm 21 and the platform 65, top rail 66 and mid-rail 67 of the lower and upper worker support cages 15 and 16 are collapsed or folded to the stowed positions. The mid-rail 67 is folded upwards against the mast 8 first, then the top rail 66 is folded downward over the mid-rail 67 and the platform 65 is the folded upward over the top rail 66. The two ladder sections 76 and 77 are laid on top of one another and on top of the undersides of the platforms 65 which face upwards when the platforms 65 are in the stowed position. One set of vertical cage supports 68 and 69 are also set on the underside of each platform 65 adjacent the ladder sections 76 and 77. In addition, although not shown in FIG. 2, the upper ladder support 24 and the conduit 64 are set on the underside of either platform 65. The ladder supports 22 and 23 are mounted or bolted on the upper and lower platforms 65 prior to shipping of the mast assembly 1. The ladder sections 76 and 77, the vertical cage supports 68 and 69, conduit 64 and the upper ladder support 24 are held in place during transport by strapping them to the rest of the mast assembly 1. Additional hardware, including safety or locking bolts and mating nuts can be stored in the junction box 61 during transport.

Figure 10:
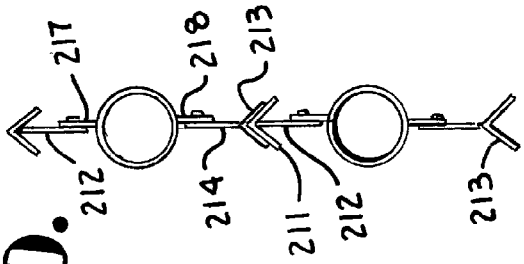
FIG. 10 is a partially schematic, end view of two stacked signal mast assemblies as shown in FIG. 2, showing upper stacking brackets for supporting one assembly above the other.

Referring to FIGS. 2 and 10, the upper stacking bracket assembly 27 includes an elongated v-shaped male stacking member 211 mounted on a male bracket arm 212, and a mating or v-shaped female stacking member 213 mounted on a female bracket arm 214. The male bracket arm 212 is bolted to a first mounting tab 217 welded to the front of the mast 8 such that the male stacking member 211 extends in front of the mast 8 and opens inwards, towards the mast 8 with a leading edge projecting away from the mast 8. The female bracket arm 214 is bolted to a second mounting tab 218 welded to the rear of the mast 8 such that the female stacking member 212 extends in behind the mast 8 and opens away from the mast 8. The longitudinal axis of the male and female stacking members 211 and 213 extend parallel to the axis of the mast longitudinal axis.

When one mast assembly 1 is stacked on a second mast assembly 2, the v-shaped female stacking member 213 is positioned to rest on and receive the v-shaped male stacking member 211 of the mast assembly 2 positioned therebelow. Another mast assembly can then be stacked on top of mast assembly 1, by resting the female stacking member 213 of the third mast assembly (not shown) on top of the male stacking member 211 of the mast assembly 1. The longitudinal orientation of the male and female stacking members 211 and 213 restrains the upper ends of the stacked mast assemblies 1 and 2 from shifting laterally relative to one another.

The lower stacking bracket assembly 28 is adapted to be mounted on the base plate 40 to facilitate storage and transport of the mast assembly 1 and is removed before the mast assembly 1 is installed on a footing 3. As best seen in FIGS. 2, 8 and 9, each lower stacking bracket assembly 28 comprises an elongated v-shaped male stacking member 221 and an elongated v-shaped female stacking member 223 connected together in spaced apart and parallel relation by side walls 225 and 226. The male stacking member 221, female stacking member 222 and side walls 225 and 226 generally form an isosceles trapezoid, wherein the male stacking member 221 and the female stacking member 223 are substantially parallel and the female stacking member is positioned below and is shorter than the male stacking member 221. Shortening the female stacking member 223 relative to the male stacking member 221 facilitates stacking the female stacking member 223 on top of the male stacking member 221 and between the side walls 225 and 226. Upper ends of the side walls 225 and 226, extending above the male stacking member 221 are additionally angled outward to further facilitate stacking and function as guide rails.

A load bearing strut 229 extends between and is welded on opposite ends to each side wall 225 and 226 parallel to and in closely spaced relation below the male stacking member 221. When the lower stacking bracket 28 is installed on or attached to the base plate 40, an inner, horizontal surface 230 of the strut 229 rests against an upwardly facing edge 232 of the base plate 40 when the mast assembly 1 in a horizontal, transport orientation. A mounting strap or plate 234 extends diagonally between the male and female stacking members 221 and 223 and has two bolt holes formed therein which can be aligned with two diagonally opposed bolt holes or slots 42 in the mast base plate 40 for bolting the lower stacking bracket assembly 28 to the bottom of the base plate 40.

When a first mast assembly 1 is stacked on a second mast assembly 2, the v-shaped female stacking member 223 is positioned to rest on and receive the v-shaped male stacking member 221 of the mast assembly 2 positioned therebelow. Another mast assembly can then be stacked on top of mast assembly 1, by resting the female stacking member 223 of the third mast assembly (not shown) on top of the male stacking member 221 of the mast assembly 1. The horizontal orientation of the male and female stacking members 221 and 223 of the lower stacking bracket assemblies 28 restrains the stacked mast assemblies 1 and 2 from shifting longitudinally relative to one another. The engagement of lower ends of the side walls 225 and 226 of one lower stacking bracket 28 against the upper ends of the side walls 225 and 226 of the lower stacking bracket 28 positioned therebelow restrains the lower ends of the stacked mast assemblies 1 and 2 from shifting laterally relative to one another.

The lower stacking bracket assemblies 28 are further provided with two lower stacking bracket feet 237 which facilitate sliding of the lower end of the mast assembly 1 as it is slid along a surface such as onto a truck bed or along the ground during installation. The stacking bracket feet 237 are triangular with a rounded outer end or apex. The hypotenuse 238 of each foot 237 is connected to one of the side walls 225 and 226. A base 239 of each foot 237 is welded to an outer edge of the female stacking member 223.

Assembly and Installation

Once a mast assembly 1, as shown in FIG. 2 in the stowed position, is transported to an installation site and the assembly 1, a fork lift or boom truck can be used to lift the top signal mast assembly 1 off of the others and lower it to the ground so that it rests in a horizontal alignment supported by the upper and lower stacking bracket assemblies 27 and 28. The relatively wide base provided by the female stacking member 223 of the lower stacking bracket 28 restrains the mast assembly 1 from inadvertently rotating on the ground.

Once on the mast assembly 1 is on the ground, straps holding the components together are removed and the two ladder sections 76 and 77, the two sets of vertical cage supports 68 and 69 and the upper ladder support 24 are removed from the assembly 1 and the hardware including safety or locking bolts for securing the components in the use position are removed from the junction box 61. The ladder sections 76 and 77 are bolted together as described previously to form a single ladder assembly 18.

The lower ladder support 21 is pivoted to the use position and secured in place with locking or safety bolts as discussed previously. The lower worker support cage 15 is then assembled by pivoting the platform 65 downward and into the perpendicular, use position and secured in place with locking bolts 110 inserted through aligned holes 102 and 104 in the overlapping hinge arms 92 and 94. The top rail 66 is then pivoted upward to the perpendicular, use position and secured in place with a locking bolt 144 inserted through aligned holes 139 and 141 in overlapping hinge arms 131 and 133. The mid-rail 67 is then pivoted downward to the perpendicular, use position and secured in place with locking bolt 164 extending through aligned holes in hinge members 158 and 159. A first set of the vertical cage support members 68 and 69 are then bolted to the left and right sides of the platform 65, top rail 66 and mid-rail 67 of the lower support cage 15 as described previously.

The second or upper worker support cage 16 is then assembled in a similar manner, except that the upper ladder support 24 is bolted to the left side mounting bracket 171 on the left side segment 116 of the top rail 66 at the same time that the upper mounting flange 167 of the vertical cage support 68 is bolted thereto. The ladder assembly 18 is then bolted to the ladder supports 21-24. Signal light assemblies 31 can be attached to the signal mounting arms 10-12 either before the mast 1 is lifted to its vertical alignment or afterwards and is generally left to the preference of the purchaser or installer.

With the mast assembly 1 fully assembled, the assembly 1 can be lifted into a vertical alignment using a boom truck or the like. A strap or chain connected to a boom truck can be secured around the upper end 36 of the mast 8 by wrapping the strap around the upper stacking bracket assembly 27 for use in lifting the mast assembly 1. Once the mast assembly 1 is lifted off the ground, the lower stacking bracket assembly 28 is unbolted from and removed from the base plate 40. The mast assembly 1 is then positioned over the foundation 3 and lowered into position with the threaded studs projecting upward from the foundation extending through the bolt receiving slots 42 in the base plate 40. The mast assembly 1 is then secured in place by using washers and threading nuts onto the foundation studs or bolts.

It is to be understood that while certain forms of the present invention have been illustrated and described herein, it is not to be limited to the specific forms or arrangement of parts described and shown. For example, it is foreseen that means for providing a pivotal connection between the platform and the mast and the support rails and the mast, other than the hinges of the type disclosed could be utilized including different types of hinges. In addition, the bolt type connectors shown about which the platforms and rails pivot could be replaced with other types of pivot pins. Similarly, connectors or means for securing the platform and the support rails in the use position, other than the locking bolts disclosed, could be utilized, including various types of locking pins or detents or other connectors which are automatically engaged when the platform is first advanced to the use position. Moreover it is to be understood that once the cages 15 and 16 are assembled, the safety bolts 110 for platform 65, safety bolts 144 for top rail 66 and safety bolt 164 for mid-rail 67 could be removed and the remaining bolts connecting the vertical support members 68 and 69 to the platform 65, top rail 66 and mid-rail 67 along with platform stop described previously will function to hold or secure the platform 65, top rail 66 and mid-rail 67 in the use positions.

It is also to be understood that in an application in which the mast 6 only includes a single cage mounted at a higher level, such as cage 16 in FIG. 1, a second ladder support similar in construction to ladder support 21 could be connected to the mast 6 at the level of cage 15. More specifically, the second ladder support could be mounted to the hinge arms 92. The second ladder support would be modified to position the ladder support pivot arm further to one side of the mast 6 to accommodate the incline of the ladder.

It is also recognized that some railroads or customers may want a ladder extension (not shown) attached to the bottom of the lower ladder section 76 to extend into a gravel pad or the like to ensure rungs of the ladder assembly 18 extend all the way to the ground. Such a ladder extension can be bolted onto the lower end of the ladder section 76.

I claim:

1. A railway signal mast assembly comprising:

a mast having a lower end and an upper end;

at least one signal mounting arm connected to said mast; said at least one signal mounting arm adapted for supporting a railway signal assembly thereon;

at least one worker support platform pivotally connected to said mast and pivotable from a stowed position to a use position; wherein in said stowed position said support platform extends approximately parallel to a longitudinal axis of said mast and in said use position said support platform extends generally perpendicular to said longitudinal axis of said mast; said platform connected to said mast in a position adapted for supporting a worker to access a railway signal assembly supported on said at least one signal mounting arm; and at least one support rail mounted connected to said mast in spaced relation above said support platform and pivotal between a stowed position and a use position; wherein in said stowed position a plane occupied by said support rail extends generally parallel to said longitudinal axis of said mast and in said use position the plane occupied by said rail extends generally perpendicular to said longitudinal axis of said mast.

2. The railway signal mast assembly as in claim 1 wherein said worker support platform and said at least one support rail comprise a worker support assembly;

said railway signal assembly further comprising:

a first ladder support pivotally connected to said mast below said worker support assembly and pivotal between a stowed position and a use position; wherein in said stowed position said ladder support extends generally parallel to said longitudinal axis of said mast and in said use position said ladder support extends generally perpendicular to said longitudinal axis of said mast;

a second ladder support connected to said worker support assembly such that when said worker support platform and said at least one support rail are pivoted to said use position, said second ladder support extends generally perpendicular to said longitudinal axis of said mast; and a ladder removably securable to said railway signal mast assembly such that a lower portion of said ladder is connected to said first ladder support in said use position and a second portion of said ladder is connected to said second ladder support when said worker support platform and said at least one support rail are in said use position.

3. The railway signal mast assembly as in claim 2, wherein said ladder is formed from a plurality of substantially identically dimensioned ladder sections connectable together to form said ladder.

4. The railway signal mast assembly as in claim 1 wherein said railway signal mast assembly comprises a first railway signal mast assembly and said first railway signal mast assembly is adapted for stacking with at least a second railway signal mast assembly; each of said first and second railway signal mast assemblies including:

an upper stacking bracket assembly attached to said mast proximate an upper end thereof; said upper stacking bracket assembly including first and second upper mating stacking brackets projecting from opposite sides of said mast column; said first upper mating stacking bracket on said first signal mast assembly matingly supporting said second upper mating stacking bracket on said second signal mast assembly; and a lower stacking bracket assembly attached to said lower end of said mast column said lower stacking bracket assembly including first and second lower mating stacking brackets extending in spaced relation on opposite sides of said mast; said first lower mating stacking bracket on said first signal mast assembly matingly supporting said second lower mating stacking bracket on said second signal mast assembly.

5. The railway signal assembly as in claim 4 wherein said lower stacking bracket assemblies are removably attached to said signal mast.

6. A railway signal mast assembly adapted for shipping to an installation site as a first railway signal mast assembly of a plurality of mast assemblies; said first railway signal mast assembly comprising:

a mast having a base and an upper end and having at least one railway signal support arm connected thereto for supporting a railway signal;

at least one platform pivotally connected to said mast and pivotal between a stowed position for transport and a use position to facilitate access by a worker to a railway signal supported on said railway signal support arm;

an upper stacking assembly connected to said mast proximate an upper end thereof; said upper stacking assembly having a first upper stacking member extending on a first side of said mast and a second upper stacking member extending on a second side of said mast, said first and second upper stacking members having mating geometries such that a second upper stacking member from a second mast assembly positioned above said first mast assembly can be supported on the first upper stacking member of said first mast assembly; and a lower stacking assembly connected to said mast at or proximate to said base; said lower stacking assembly having a first lower stacking member extending on the first side of said mast and a second lower stacking member extending on a second side of said mast; said first and second lower stacking members having mating geometries such that a second lower stacking member from a second mast assembly positioned above said first mast assembly can be supported on the first lower stacking member of said first mast assembly.

7. The first railway signal mast assembly as in claim 6 wherein said lower stacking assembly is removably securable to said base of said mast.

8. The first railway signal mast assembly as in claim 6 in combination with said second railway mast assembly and wherein the mating geometries of said first upper stacking member of said first railway mast assembly restrain said upper end of said second railway mast assembly from moving laterally relative to said upper end of said first railway mast assembly on which said second railway mast assembly is supported; and wherein the mating geometries of said first lower stacking member of said first railway mast assembly restrain said mast of said second railway mast assembly from moving longitudinally relative to said mast of said first railway mast assembly on which said second railway mast assembly is supported.

9. The first railway signal mast assembly as in claim 6 further comprising:

at least one support rail pivotally connected to said mast and pivotal between a stowed position and a use position and selectively securable in said use position.

10. The first railway signal mast assembly as in claim 6 further comprising:

a top support rail pivotally connected to said mast above said platform and pivotal between a stowed position and a use position and selectively securable in said use position; and a mid support rail pivotally connected to said mast between said platform and said top support rail and pivotal between a stowed position and a use position and selectively securable in said use position.

11. The first railway signal mast assembly as in claim 6 further comprising:

a first ladder support pivotally connected to said mast below said platform and pivotal between a stowed position and a use position;

a second ladder support connected to said platform; and a ladder removably securable to said railway signal mast assembly such that a lower portion of said ladder is connected to said first ladder support in said use position and a second portion of said ladder is connected to said second ladder support when said platform is in said use position.

12. The railway signal mast assembly as in claim 11, wherein said ladder is formed from a plurality of substantially identically dimensioned ladder sections connectable together to form said ladder.

13. A railway signal mast assembly comprising:

a mast having a lower end and an upper end;

at least one signal mounting arm connected to said mast; said at least one signal mounting arm adapted for supporting a railway signal assembly thereon;

at least one worker support platform pivotally connected to said mast and pivotable from a stowed position to a use position; wherein in said stowed position said support platform extends approximately parallel to a longitudinal axis of said mast and in said use position said support platform extends generally perpendicular to said longitudinal axis of said mast; said platform connected to said mast in a position adapted for supporting a worker to access a railway signal assembly supported on said at least on signal mounting arm;

a first ladder support pivotally connected to said mast below said platform and pivotal between a stowed position and a use position;

a second ladder support connected to said worker support platform; and a ladder securable to said railway signal mast assembly such that a lower portion of said ladder is connected to said first ladder support in said use position and a second portion of said ladder is connected to said second ladder support when said platform is in said use position.

14. The railway signal mast assembly as in claim 13 further comprising:

at least one support rail pivotally connected to said mast and pivotal between a stowed position and a use position.

15. The railway signal mast assembly as in claim 14 further comprising:

a top support rail pivotally connected to said mast above said platform and pivotal between a stowed position and a use position; and a mid support rail pivotally connected to said mast between said platform and said top support rail and pivotal between a stowed position and a use position.

* * * * *